US009364101B1

(12) United States Patent
Anderson

(10) Patent No.: US 9,364,101 B1
(45) Date of Patent: Jun. 14, 2016

(54) GLASS DOOR FOR DISPLAY CASE

(71) Applicant: Structural Concepts Corporation, Muskegon, MI (US)

(72) Inventor: Viktor John Anderson, Muskegon, MI (US)

(73) Assignee: STRUCTURAL CONCEPTS CORPORATION, Muskegon, MI (US)

( * ) Notice: Subject to any disclaimer, the term of this patent is extended or adjusted under 35 U.S.C. 154(b) by 0 days.

(21) Appl. No.: 14/725,143

(22) Filed: May 29, 2015

(51) Int. Cl.
*A47F 3/00* (2006.01)
*E05D 15/00* (2006.01)
*E06B 7/16* (2006.01)

(52) U.S. Cl.
CPC ..... *A47F 3/007* (2013.01); *E05D 15/00* (2013.01); *E06B 7/16* (2013.01); *A47F 2003/008* (2013.01); *E05D 2700/00* (2013.01)

(58) Field of Classification Search
CPC . A47F 3/043; A47F 3/0434; A47F 2003/008; E05Y 2900/202; E05Y 2900/204; A47B 87/005; A47B 87/007; A47B 87/008; A47B 87/02; A47B 87/0215; A47B 87/0276; A47B 87/0284; A47B 87/0292; A47B 47/0091; A47B 47/0075; A47B 43/00
USPC ..... 312/137, 138.1, 139, 140, 327, 328, 312/290, 296; 49/386; 52/204.62, 285.1
See application file for complete search history.

(56) References Cited

U.S. PATENT DOCUMENTS 646,601 A * 4/1900 Hasak ..... A47F 5/005 312/140
730,294 A * 6/1903 Pollard ..... A47F 5/005 312/140
1,044,749 A * 11/1912 Cobb ..... A47F 3/12 312/137
1,379,553 A * 5/1921 Gloekler ..... A47F 3/12 312/137
1,876,423 A * 9/1932 Kennedy ..... A47F 5/005 24/458
2,115,531 A * 4/1938 Simon ..... A47F 3/12 312/140
2,667,246 A * 1/1954 Ghersin ..... E06B 1/38 312/140

(Continued)

FOREIGN PATENT DOCUMENTS

DE 4234945 * 4/1994
DE 202010014699 * 2/2011

(Continued)

OTHER PUBLICATIONS

"Glass Display Box, Glass Bevel Display Box, Stained Glass Display Box, 9"×9"×6" Tall, Wedding Gift, Memory Box, Home Décor," https:/1\w,w.etsy.com'listing/151891299/glass-display-box-glass-bewl-display?ref=market (Acknowledged Prior Art).

*Primary Examiner* — Janet M Wilkens
(74) *Attorney, Agent, or Firm* — Warner Norcross and Judd LLP

(57) ABSTRACT

A display case having a novel glass door. The glass door includes a top panel and a front panel bonded to one another, and a pair of spaced rails reinforcing the interconnection of the top and front panels. Each of the panels is secured to each of the rails. The glass door provides enhanced viewing of products within the display cabinet.

7 Claims, 5 Drawing Sheets

(56) References Cited

U.S. PATENT DOCUMENTS

| | | | | | |
|---|---|---|---|---|---|
| 3,193,340 | A * | 7/1965 | Braden | A47L 15/488 | 220/327 |
| 4,551,364 | A | 11/1985 | Davies | | |
| 4,560,214 | A * | 12/1985 | Otema | A47F 3/005 | 312/114 |
| 4,660,903 | A | 4/1987 | Shinagawa | | |
| 5,513,764 | A * | 5/1996 | Harrison | A47G 19/2255 | 215/372 |
| 5,533,314 | A | 7/1996 | Kunert | | |
| 5,622,414 | A * | 4/1997 | Artwohl | A47F 3/007 | 312/116 |
| 6,105,336 | A | 8/2000 | Katoh et al. | | |
| 6,634,460 | B1 * | 10/2003 | Hackenberg | A47F 3/007 | 186/38 |
| 7,332,202 | B2 | 2/2008 | Demars et al. | | |
| 7,891,154 | B2 | 2/2011 | Cording | | |
| 8,104,237 | B2 | 1/2012 | Esemann et al. | | |
| 8,209,922 | B2 | 7/2012 | Petersen | | |
| 8,308,249 | B2 * | 11/2012 | Matus, Jr. | A47F 3/007 | 312/137 |
| 2006/0048468 | A1 | 3/2006 | Demars et al. | | |
| 2007/0087140 | A1 | 4/2007 | Dierks | | |
| 2011/0220097 | A1 | 9/2011 | Ventelon et al. | | |
| 2014/0023802 | A1 | 1/2014 | Margalit | | |
| 2014/0050867 | A1 | 2/2014 | Zhao et al. | | |

FOREIGN PATENT DOCUMENTS

| | | | |
|---|---|---|---|
| EP | 2728099 | A1 | 7/2014 |
| WO | 2005021886 | A1 | 3/2005 |

* cited by examiner

GLASS DOOR FOR DISPLAY CASE

BACKGROUND OF THE INVENTION

The present invention relates to a glass doors, and more particularly to a glass doors for a display cases.

Display cases or cabinets are well known and widely used for the retail display of merchandise such as food and flowers. Such cases often include an access door that may be lifted by the customer to access the products. In some display cases, the door is a single panel of curved glass. However such panels are relatively expensive and increase the cost of the display case.

In other display cases, the door includes multiple panels of glass within a metal frame. Unfortunately, the frame detracts from the aesthetics of the case, and the frame interferes with view of the product within the display case.

SUMMARY OF THE INVENTION

The noted issues are addressed by the present invention providing a glass door for a display case that includes multiple glass panels but is substantially frameless. The present glass door increases the visibility of the products within the display case.

In the disclosed embodiment, the glass door includes a glass top panel and a glass front panel glued to one another. The door further includes side rails each secured to both of the panels to assist in maintain the panels in a desired relationship with respect to one another.

The present glass door reduces, and potentially eliminates, the need for metal peripheral framing around the glass panels. The door therefore provides improved aesthetics, increased product visibility, and the requisite structural integrity, especially to be used in hinged applications.

These and other features and advantages of the invention will be more fully understood and appreciated by reference to the entire application including the specification, the claims, and the drawings.

DESCRIPTION OF THE CURRENT EMBODIMENT

Figure 1:
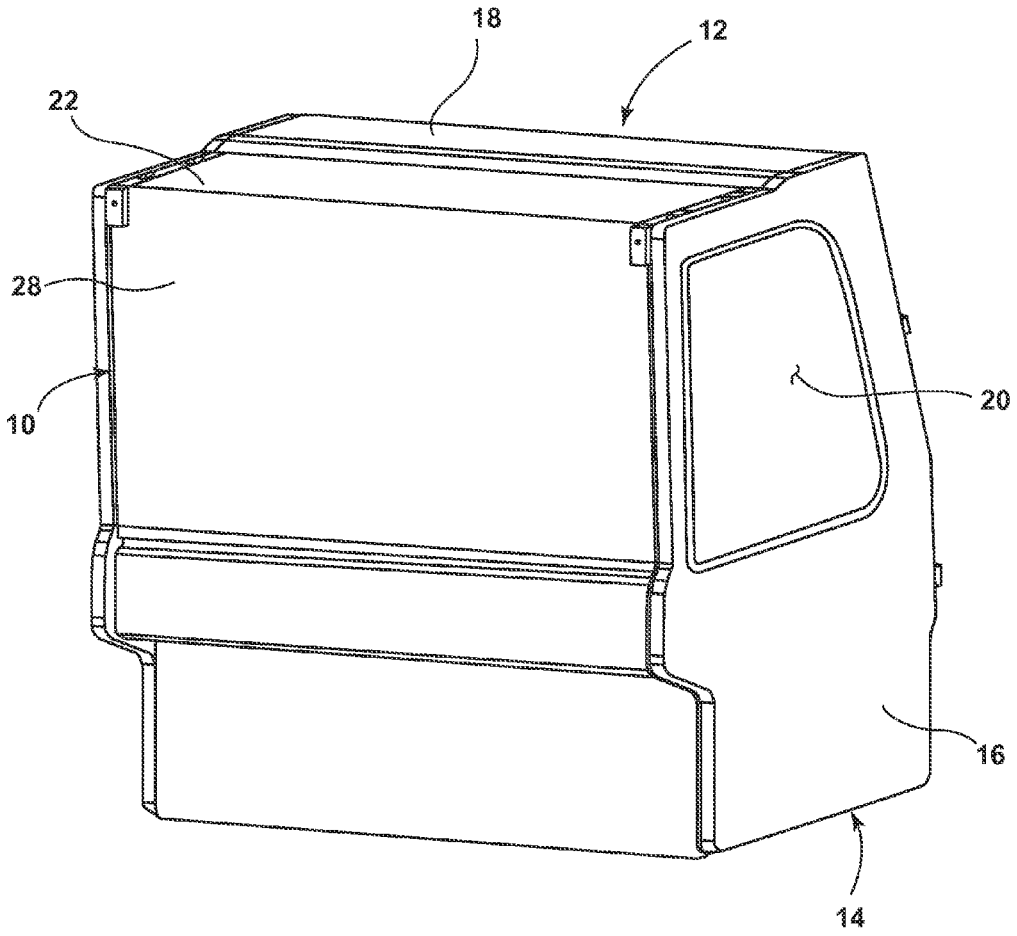
FIG. 1 is a front perspective view of a display case including a glass door.
Figure 2:
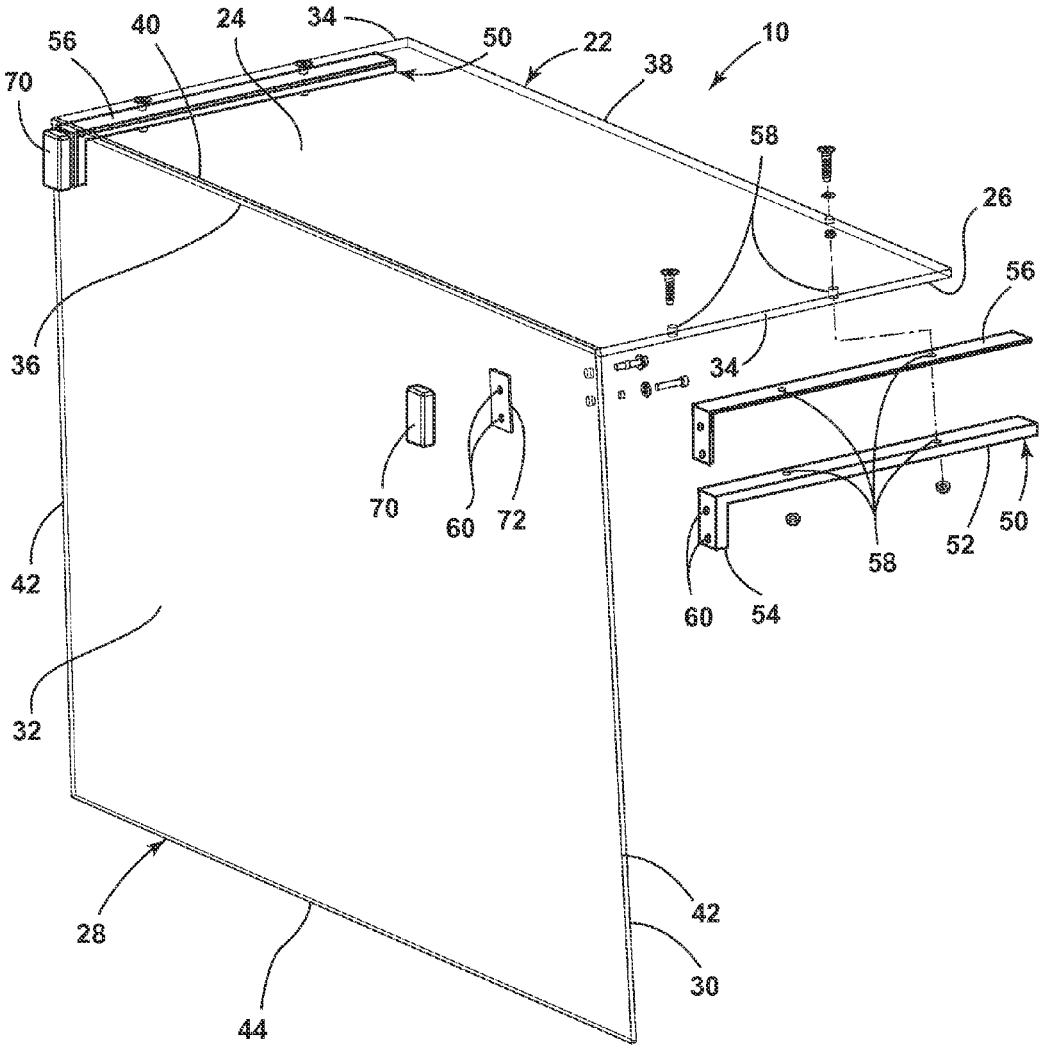
FIG. 2 is a partially exploded front perspective view of the glass door.
Figure 3:
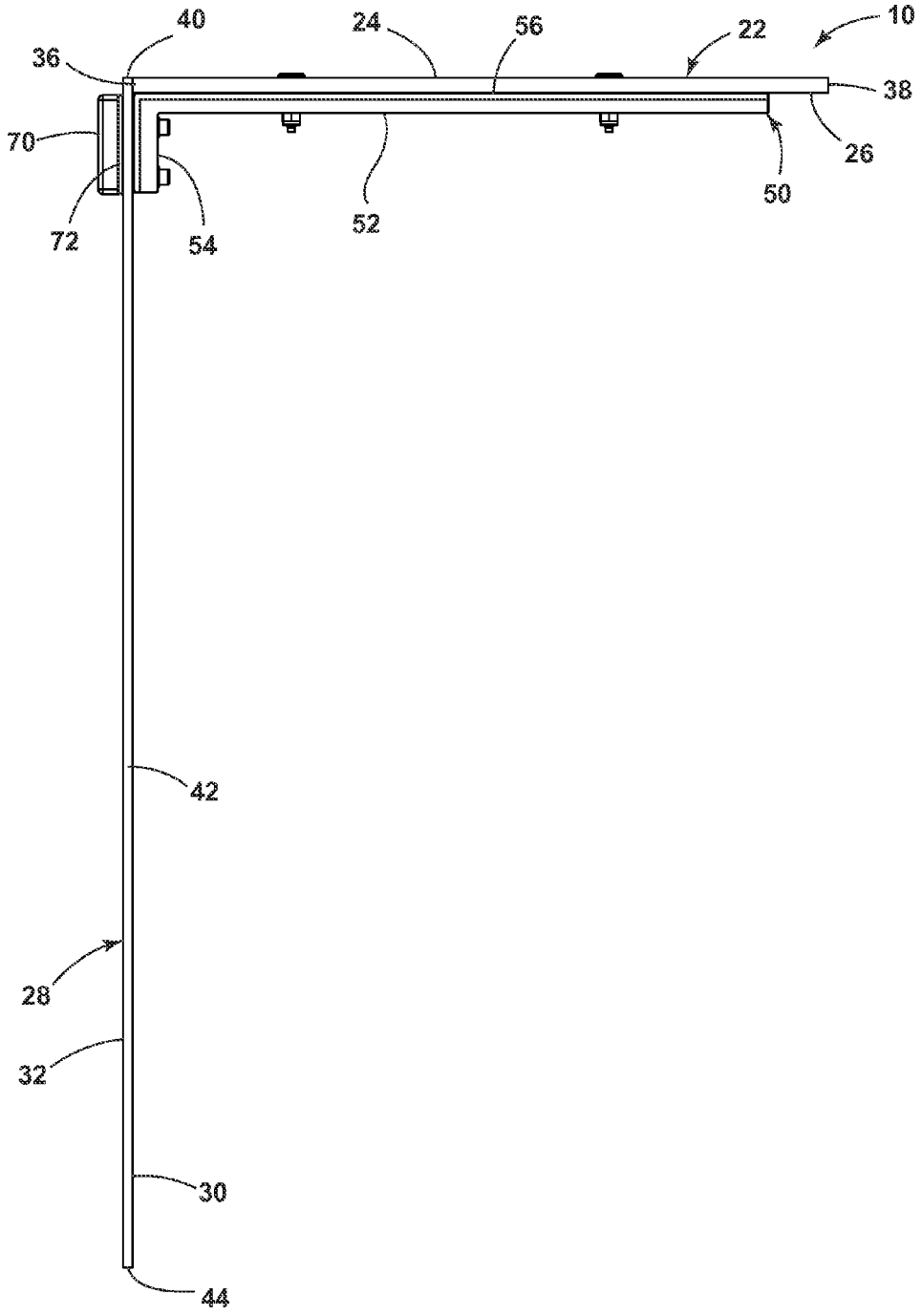
FIG. 3 is a side view of the glass door.
Figure 4:
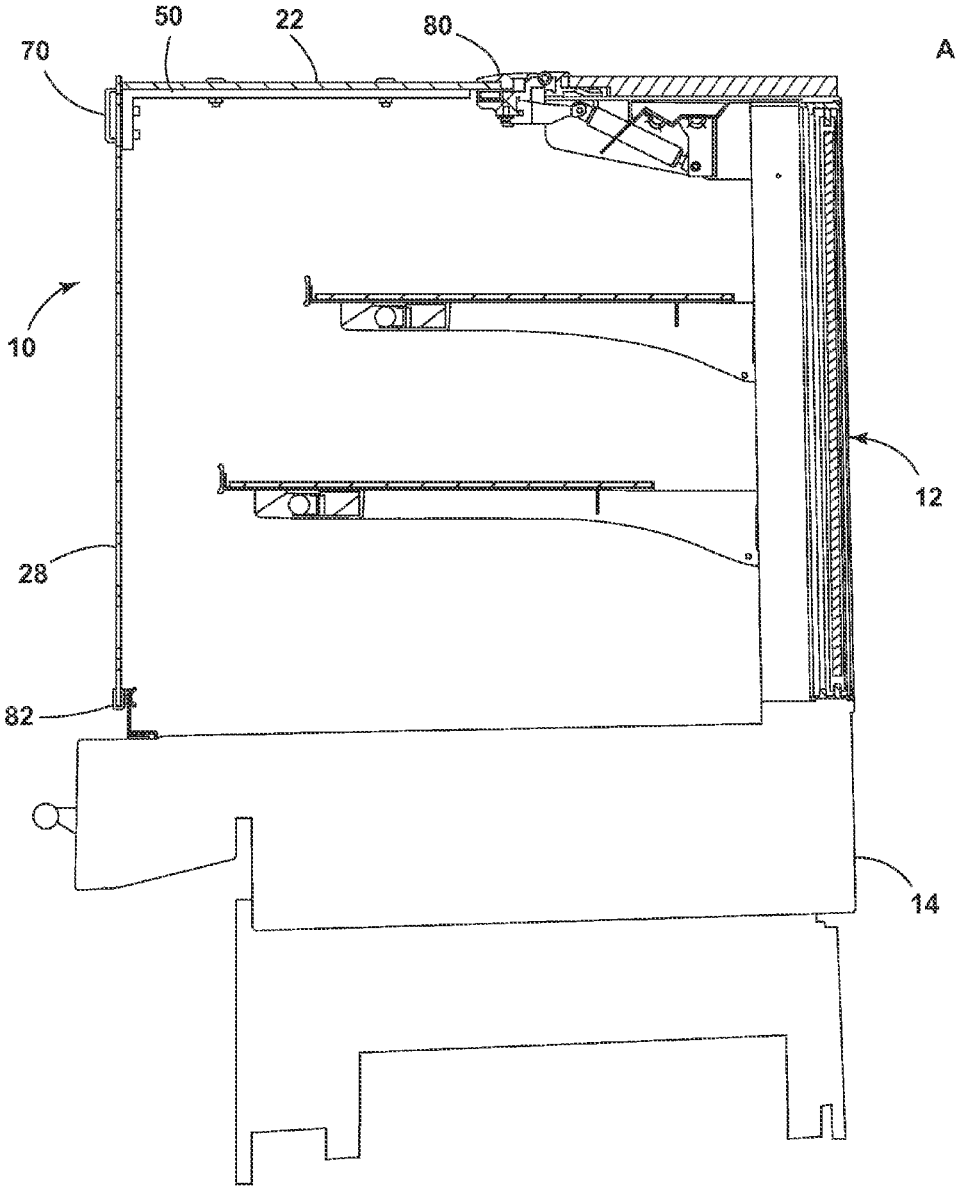
FIG. 4 is a cross-sectional view taken along line IV-IV in FIG. 1.
Figure 5:
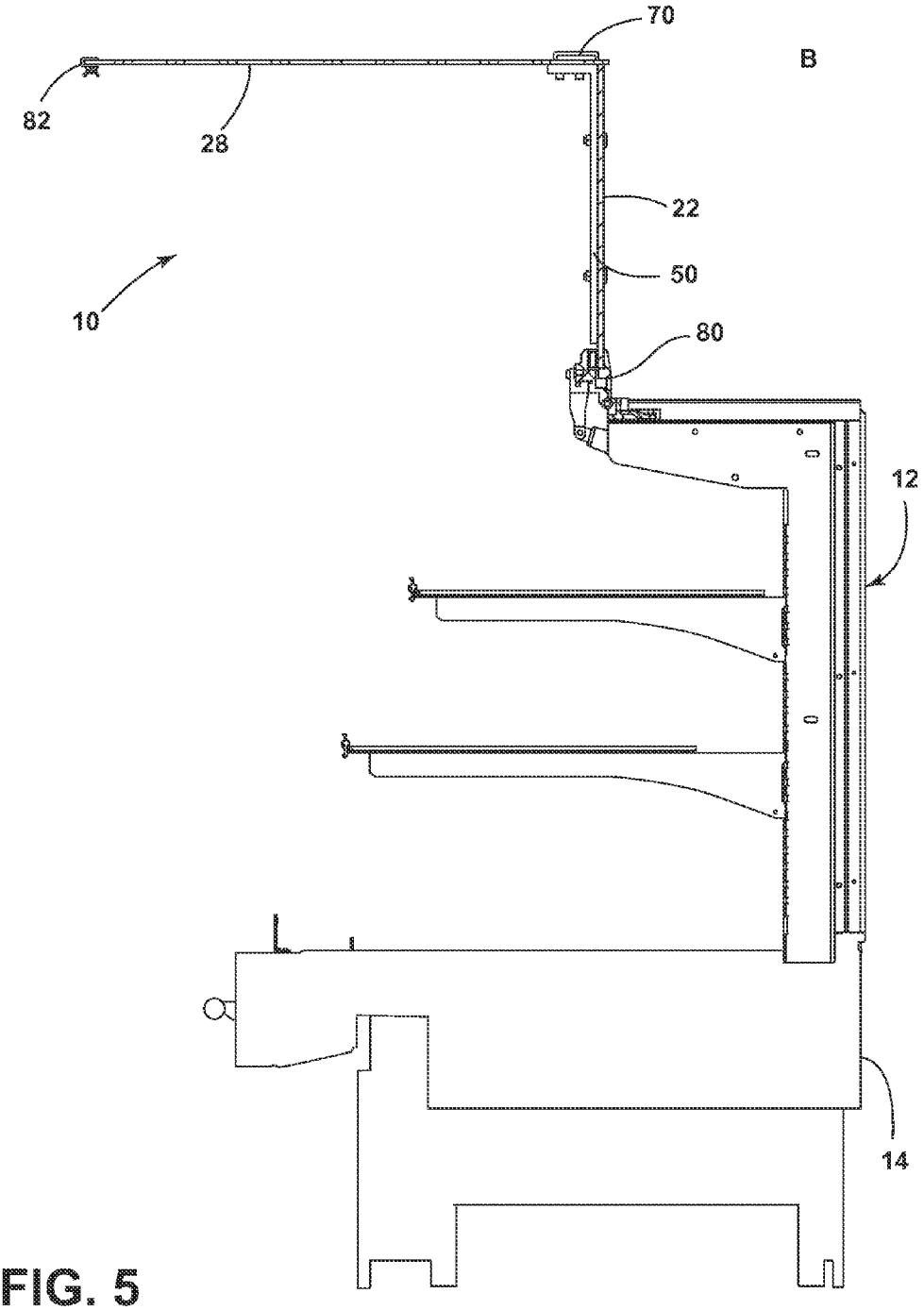
FIG. 5 is a cross-sectional view similar to FIG. 4 but showing the glass door in the fully open position.

A display case or cabinet 12 including a glass door or enclosure 10 in accordance with an embodiment of the invention is illustrated in FIGS. 1-5. The display case 12 is of the type used in supermarkets, coffee shops, and other retail environment to display products and merchandise such as food and floral items.

Throughout this description, directional terms, such as "upper", "lower", "inner", "outer", "front", and "rear", are used based on the orientation of the embodiment shown in the drawings. The "front" side of the display case 12 is the side from which the customer would view the display case contents through the glass door 10. The use of directional terms does not limit the embodiment or the invention to any specific orientation(s).

The display case 12 includes a cabinet housing 14 of conventional construction including opposed side walls 16 and a raised countertop 18. The cabinet housing 14 defines an interior space 20, which may include shelving therein. The display case 12 may or may not be refrigerated.

The glass door 10 includes a substantially horizontal glass top panel 22 having an upper surface 24 and a lower surface 26. The glass door 10 also includes a generally vertical, glass front panel 28 having an inner surface 30 and an outer surface 32. The top panel 22 defines four edges: two opposed side edges 34, a front edge 36, and a rear edge 38. The front panel 28 also defines four edges: an upper edge 40, two opposed side edges 42, and a lower edge 44.

As illustrated, the panels 22 and 28 are generally perpendicular to one another, forming a corner therebetween. However, the angle between the panels 22 and 28 may be varied as desired. The upper edge 40 of the front panel 28 is glued or otherwise bonded to the lower surface 26 of the top panel 22 along the front edge 36 of the top panel 22. Alternatively, the front edge 36 of the top panel 22 may be bonded to the inner surface 30 of the front panel 28. The number, the shapes, and the orientations of the panels may vary depending on the desired shape of the enclosure.

Although the bonding material is not illustrated in the drawings, the panels 22 and 28 are bonded together using any suitable adhesive, glue, or other bonding material or agent. In the current embodiment, the bonding material is ultraviolet adhesive, also known as ultraviolet light curing adhesive, in which ultraviolet light activates and cures the adhesive. Ultraviolet adhesives are transparent even after curing, have a relatively short curing time, and provide strong bond strength. Transparent adhesives are preferred because of their reduced visibility.

The glass door 10 also includes two side rails 50. Each side rail 50 is a substantially L-shaped bracket having a horizontal portion 52 and a downward extending portion 54. The side rails 50 are structural members that are mounted to the top panel 22 along its side edges 34 and to the front panel 28 along its side edges 42. In addition, a gasket 56 is provided between each side rail 50 and the top and front panels 22 and 28. The gasket 56 is also a substantially L-shaped member and provides vibrational dampening between the side rail 50 and the lower surface 26 of the top panel 22 and the side rail 50 and the inner surface 30 of the front panel 28. The side rails 50 and gaskets 56 define apertures 58 on the horizontal portion 52 and apertures 60 on the downward extending portion 54. In the current embodiment, the side rails 50 and gaskets 56 each include two apertures 58 through the horizontal portion 52 and two second apertures 60 through the downward extending portion 54. The number of apertures 58 and 60 may be varied.

The glass door 10 includes two substantially rectangular end caps 70 mounted to the front panel 28 near the corners formed between the side edges 42 and upper edge 40 of the front panel 28. Although not shown, the inner surface of the end cap 70 defines spaced apertures for receiving associated fasteners. A second gasket 72 is provided on the outer surface 32 of the front panel 28 between each end cap 70 and the front panel 28.

The top panel 22 defines apertures 58 aligned with the corresponding apertures 58 in the horizontal portion 52 of the side rails 50. That is, the top panel 22 defines spaced apertures 58 along the side edges 34 thereof. Similarly, the front panel 28 defines apertures 60 aligned with the corresponding apertures 60 in the downward extending portion 54 of the side rail 50 and the bores in the end cap 70. Fasteners, for example screws, secure the top panel 22 to the side rails 50. Additional fasteners secure the downwardly extending portions 54 of the side rails 50 to the front panel 28 and the end caps 70. The side rails 50 and the end caps 70 provide increased structure and rigidity to the interconnection of the abutting panels 22 and 28. Other suitable fasteners may be used.

The end caps 70 preferably are appropriately sized to cover the downward extending portion 54 of the side rails 50 to further enhance aesthetics as viewed by a customer standing in front of the display case 12. While the end caps 70 are shown as being rectangular in shape, other shapes are contemplated.

The glass door 10 may be hingedly mounted to the cabinet housing 14 in conventional fashion. The display case 12 may include a hinge or lift mechanism 80 connected to the rear edge 38 of the top panel 22 for pivotally mounting the glass door 10 to the cabinet housing 14. The glass door 10 is configured to selectively pivot between a closed position A illustrated in FIG. 4, in which the interior space 20 is enclosed, and an open position B illustrated in FIG. 5, in which the interior space 20 is accessible by a customer.

Optionally, a seal or bumper 82 may be included along the lower edge 44 of the front panel 28 for sealing engagement and/or vibration damping between the front panel 22 and the cabinet housing 14. Additional seals or bumpers may be installed along the side edges 34 and 42 of the top and front panels 22 and 28.

The glass door 10 may be located in other areas in or on the display case 12, and indeed multiple glass doors could be provided.

The construction of the present glass door 10 eliminates the metal frame, as is conventional, along the upper front edge of the enclosure. This provides a substantially unobstructed view of the interior space 20 for a consumer standing in front of the display case 12. The glass door 10 is configured such that the consumer's view is only obstructed by the end caps 70, which cover only a small portion of the glass door 10, thereby significantly increasing the visibility of the contents within the display case 12. In contrast, a conventional glass enclosure has a metal frame that extends along the entire intersection of adjacent panels, including the upper front edge of the enclosure.

Any reference to elements in the singular, for example, using the articles "a," "an," "the," or "said," is not to be construed as limiting the element to the singular.

The above description is that of a current embodiment of the invention. Various alterations and changes can be made without departing from the spirit and broader aspects of the invention as defined in the appended claims, which are to be interpreted in accordance with the principles of patent law including the doctrine of equivalents.

The invention claimed is:

1. A display case comprising:

a cabinet housing defining an interior space; and a glass door assembly hingedly supported by the cabinet housing, the door comprising:

a glass top panel having a front edge, a rear edge, and two opposite side edges, the rear edge hingedly supported by the cabinet housing, the top panel further having an upper surface and a lower surface;

a glass front panel having an upper edge, a lower edge, and two opposite side edges, the front edge of the top panel and the upper edge of the front panel bonded to one another, the front panel further having an outer surface and an inner surface; and two rails each being L-shaped and including a top leg and a front leg meeting at an angle, the top legs adjacent the lower surface of the top panel, the front legs adjacent the inner surface of the front panel, each of the rails proximate one of the top panel side edges and one of the front panel side edges, the top panel secured to the rail top legs, the front panel secured to the rail front legs.

2. The display case of claim 1 further comprising two end caps, each end cap adjacent the outer surface of the front panel, each end cap secured to the front panel and to the front leg of one of the two rails.

3. The display case of claim 1 wherein the top and front panels are bonded to one another by ultraviolet adhesive.

4. A glass door assembly for a display cabinet, the glass door comprising:

a glass top panel having a front edge, a rear edge, and two opposite side edges, the rear edge adapted to be hingedly supported by the display cabinet, the top panel having an upper surface and a lower surface;

a glass front panel having an upper edge, a lower edge, and two opposite side edges, the front edge of the top panel and the upper edge of the front panel bonded to one another to form a corner, the front panel having an outer surface and an inner surface; and two rails each being L-shaped and including a top leg and a front leg meeting at an angle, each top leg adjacent the lower surface of the top panel, each front leg adjacent the inner surface of the front panel, each rail proximate one of the top panel side edges and one of the front panel side edges, the top panel secured to both rail top legs, the front panel secured to both rail front legs.

5. The glass door assembly of claim 4 further comprising two end caps each end cap adjacent the outer surface of the front panel, each secured to the front panel and to the front leg of one of the two rails.

6. The glass door assembly of claim 4 wherein the top and front panels are bonded to one another by ultraviolet adhesive.

7. The glass door assembly of claim 4 wherein the top and front panels define a plurality of apertures, and wherein the glass door assembly further comprises fasteners extending through the apertures and at least partially through the rails.

* * * * *